United States Patent [19]

Kerpe

[11] 4,318,477

[45] Mar. 9, 1982

[54] PHARMACEUTICAL PACKAGE

[76] Inventor: Stase Z. Kerpe, 9654 S. Kenneth, Oak Lawn, Ill. 60453

[21] Appl. No.: 189,506

[22] Filed: Sep. 22, 1980

[51] Int. Cl.[3] ..... G09F 9/00

[52] U.S. Cl. ..... 206/534; 116/308

[58] Field of Search ..... 206/534, 528, 538, 569, 206/570; 116/308

[56] References Cited

U.S. PATENT DOCUMENTS

| | | | |
|---|---|---|---|
| 341,621 | 5/1886 | Zanetti | 116/308 |
| 1,717,062 | 6/1929 | Mottayaw | 206/534 X |
| 3,182,791 | 5/1965 | Jenner | 116/308 X |
| 3,324,995 | 6/1967 | Sharp, Jr. | 206/534 |
| 3,630,171 | 12/1971 | Huck | 206/534 X |
| 3,780,856 | 12/1973 | Braverman | 206/534 |
| 4,039,080 | 8/1977 | Cappuccilli | 206/534 |
| 4,254,871 | 3/1981 | Poore | 206/534 |
| 4,282,824 | 8/1981 | Lafferty | 116/308 |

*Primary Examiner*—Steven M. Pollard
*Attorney, Agent, or Firm*—Bernard L. Kleinke

[57] ABSTRACT

A pharmaceutical package having a plurality of containers mounted on a support device and arranged in groups. Day indicia are arranged on the face of the support means opposite each one of the groups of containers for determining the containers to be emptied during each day. Each one of the containers has a receptacle which has an opened mouth for receiving and storing pharmaceutical items. A closure covers over the open mouths to retain the items therewithin, and a hinge connects the closure and the support for enabling the closure to swing between a closed position over the receptacle to retain the pharmaceutical items therein and the open position to permit access thereto. Time indicia are disposed on the outer faces of the closures for each one of the containers of each group for determining when the containers of each group are to be emptied by the user during certain times of the day and to indicate when selected ones of the closure means are disposed in their open position. Each one of the containers is sufficiently large to receive a plurality of different kinds of medication to be taken at one time. Each one of the receptacles includes a concave inner well to facilitate removal of the pharmaceutical items therefrom. Each closure may be opened readily.

9 Claims, 4 Drawing Figures

PHARMACEUTICAL PACKAGE

DESCRIPTION

1. Technical Field

The present invention relates in general to a pharmaceutical package, and it more particularly relates to a package which is adapted to contain pharmaceutical items, such as tablets, capsules or the like.

2. Background Art

There have been many different types and kinds of pharmaceutical packages. For example, reference may be made to U.S. Pat. Nos. 3,450,306; 4,038,937; 4,439,080 and 4,127,190. The pharmaceutical packages have included containers which arranged the stored pharmaceutical items in rows and columns to indicate to the user when the items are to be taken. For example, there may be three items stored in a column indicating that those three items are to be taken at three different times during the day, and there may be a total of seven such columns of stored items to indicate the seven days of the week. While these packages may be satisfactory for some applications, it would be highly desirable to facilitate greatly the indicating function of the package to help the user remember how many pills have been taken and when they have been taken. Oftentimes, the user is unable to remember clearly and make proper decisions due to an illness or due to advanced age. Also, physicians oftentimes prescribe a plurality of different kinds of pills to be taken at different times during the day, and such a package should indicate which pills are to be taken. The package should be designed to facilitate the removal of the pharmaceutical items therefrom, since it is oftentimes difficult for a patient to manipulate the small items from the package. Once items have been removed from the package, a chronically ill or aged patient, or anyone who is unable to administer properly the medication, should be able to readily and clearly distinguish between the locations on the package where items still remain and where items have been removed so as to clearly avoid confusion, thereby avoiding or at least greatly minimizing the possibility of an overdose or an underdose. In this regard, it happens all too frequently that a patient is unable to administer properly the pharmaceutical items, and therefore can take too much or too little of a potent medication, thereby resulting in bodily harm, or even death.

DISCLOSURE OF INVENTION

Therefore, the principal object of the present invention is to provide a new and improved pharmaceutical package, which facilitates removal of the items from the package, and which very clearly distinguishes between the package locations where items still remain and where items have been removed to avoid or at least to minimize confusion in the mind of the user.

Another object of the present invention is to provide such a new and improved pharmaceutical package, which greatly facilitates the proper administration of pharmaceutical items, either one or a plurality of different kinds of medications.

Briefly, the above and further objects of the present invention are realized by providing a pharmaceutical package, which has a plurality of containers mounted on a support device and arranged in groups. Day indicia are arranged on the face of the support means opposite each one of the groups of containers for determining the containers to be emptied during each day. Each one of the containers has a receptacle which has an opened mouth for receiving and storing pharmaceutical items. A closure covers over the open mouths to retain the items therewithin, and a hinge connects the closure and the support for enabling the closure to swing between a closed position over the receptacle to retain the pharmaceutical items therein and the open position to permit access thereto. Time indicia are disposed on the outer faces of the closures for each one of the containers of each group for determining when the containers of each group are to be emptied by the user during certain times of the day and to indicate when selected ones of the closure means are disposed in their open position. Each one of the containers is sufficiently large to receive a plurality of different kinds of medication to be taken at one time. Each one of the receptacles includes a concave inner well to facilitate removal of the pharmaceutical items therefrom. Each closure may be opened readily.

Therefore, by arranging the containers in groups and providing the day indicia, the user can conveniently determine which day of the week when the pharmaceutical items are to be taken. By disposing the time indicia on the outer faces of the closures for each container, the container to be opened at a certain time during the day is clearly apparent. Once opened, the closure hangs out of the way and thus its time indicia is not conspicuously exposed to view, thereby eliminating, or at least greatly reducing, the possibility of confusion by a chronically ill or elderly patient. The containers are sufficiently large to receive a plurality of different types and kinds of pharmaceutical items prescribed by the physician for being administered at certain times during the day. The concave inner well greatly facilitates the removal of the contents thereof by a person who is acting under a disability. The containers may be refilled once all of them are entirely emptied by the user, and thus the package may be reused.

BRIEF DESCRIPTION OF DRAWINGS

The above-mentioned and other objects and features of this invention and the manner of attaining them will become apparent, and the invention itself will be best understood by reference to the following description of an embodiment of the invention taken in conjunction with the accompanying drawings, wherein.

BEST MODE FOR CARRYING OUT THE INVENTION

Figure 1:
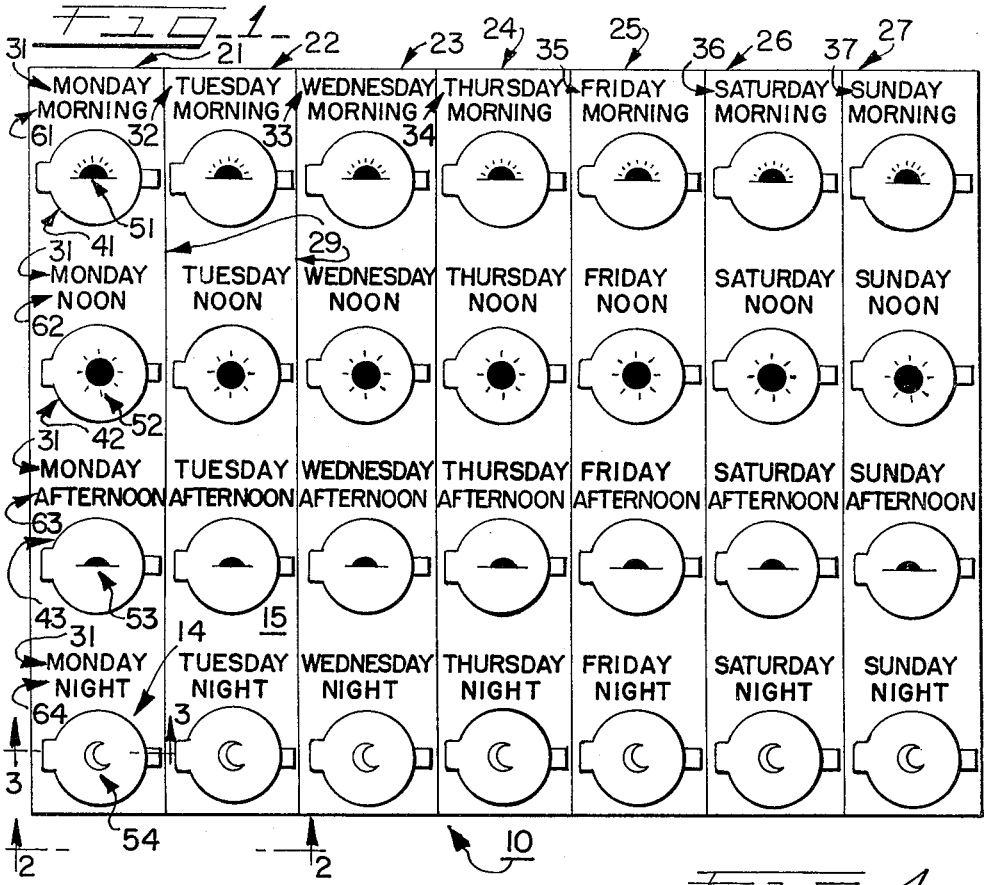
FIG. 1 is a face view of the package, which is constructed in accordance with the present invention showing each one of the containers in their closed positions.
Figure 3:
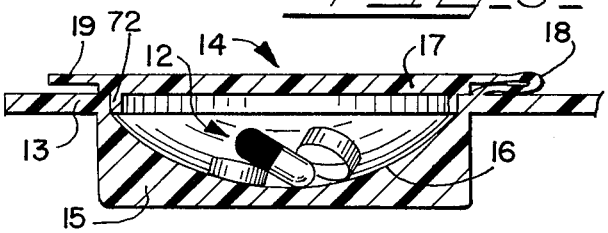
FIG. 3 is an enlarged vertical cross-sectional view of the open one of the containers of the package of FIG. 1, illustrating it in its closed position with the pharmaceutical items disposed therewithin.

Referring now to the drawings and more particularly to FIG. 1 thereof, there is shown a pharmaceutical package 10, which is constructed in accordance with the present invention and which is adapted to contain pharmaceutical items, such as the items 12 shown in FIG. 3 of the drawings, such items including tablets, capsules, or the like medication.

Figure 2:
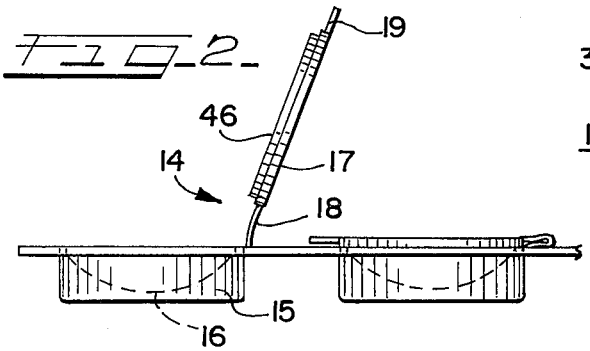
FIG. 2 is a cross-sectional fragmentary elevational view of a portion of the package of FIG. 1 illustrating it with one of the containers shown in its open position.
Figure 4:
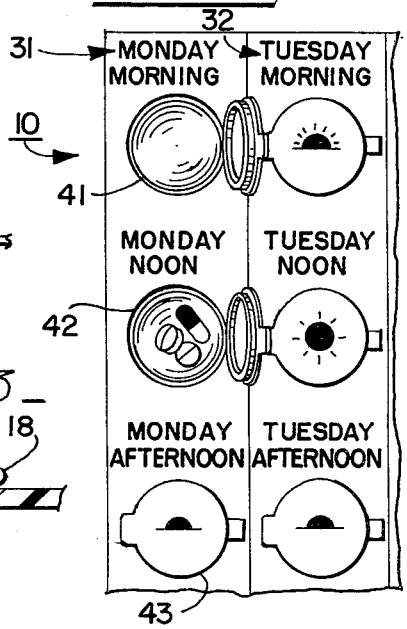
FIG. 4 is a fragmentary view of a corner portion of the package of FIG. 1 showing two of the containers in their open positions, one of which has medication removed therefrom and the other one of which being in the process of removing the contents thereof.

The package 10 generally comprises a generally flat somewhat rigid backing sheet 13 which is generally rectangular in shape and has a series of similar containers generally indicated at 14, disposed on the face 15 thereof for receiving and confining the pharmaceutical items 12. As best seen in FIG. 3 of the drawings, the containers 14 include a receptacle 15 which has an interior concave well 16. A closure or cover 17 is swingably attached to the backing sheet by means of a hinge or web 18 to swing between an open position as shown in FIGS. 2 and 4 of the drawings and a closed position as shown in FIGS. 1 and 3 of the drawings over the mouth of the receptacle 14. A finger tab 19 integrally connected to the closure 17 extends outwardly at a position opposite the hinge 18 to facilitate the moving of the closure 17 to an open position.

The containers, such as the container 14, are arranged in a series of seven column spaces 21 through 27. The The columns have associated therewith column designating indicia, such as the series of equally spaced-apart vertical column lines or bars generally indicated at 29 to facilitate the visual discernment of the divisions or boundaries between each one of the columns.

The columns include respective day indicia 31 through 37 to indicate the days of the week when the medication items are to be taken. The day indicia 31–37 comprise in the preferred form of the present invention the words identifying the days of the week. For example, the day indicia 31 is the word "MONDAY", the word indicia 32 is the word "TUESDAY", and so on. However, it will become apparent to those skilled in the art that other words or abbreviations, or symbols, may also be used. For example, the abbreviations "MON", "TUE", and so forth, may also be used.

It should be noted that the day indicia, such as the "MONDAY" day indicia 31, is repeated four times in each column and is disposed above each container in the column. Thus, for example, the "MONDAY" day indicia 31 is disposed above each one of the containers 41–43 and 14 in the column 21. Therefore, the day indicia is clearly evident to the user for each one of the containers in each one of the columns.

Each one of the columns includes a group of four containers, such as the containers 41–43 and 14 in the first column 21 arranged in equally spaced-apart alignment. Each one of the four containers in each one of the seven columns 21–27 has individually associated therewith, a time indicia, such as the indicia 51 through 54 for the containers 41 through 43 and 14, respectively. The time indicia are disposed on the outer faces of the closures and refer to the time of day when the medication is to be taken.

The time indicia are in the form of symbols. The uppermost time indicia, such as the indicia 51 on the upper container 41 in the MONDAY column 21, is a representation of the rising sun to indicate that the unedication stored in the upper containers, such as the container 41, is to be taken in the morning.

The second indicia, such as the indicia 52 in column 31, disposed immediately below the upper indicia, each comprises a symbol of a full sun indicating that the medication stored in the second containers is to be consumed during the noontime. The third indicia, such as the indicia 53, is a setting sun symbol, thereby indicating that the medication disposed in the third container, such as the container 43, is to be administered during the afternoon. The lower indicia, such as the indicia 54, is a symbol of the moon to indicate night time for the consumption of the medicine confined in the lower container.

In order to clarify the time symbol indicia 51–54 still further for the user of the package 10, a second set of time indicia, such as the time indicia 61–64, are disposed immediately under the day indicia, such as the "MONDAY" day indicia 31 repeated for each one of the containers 41–43 and 14, respectively. The time indicia 61 is the word "MORNING", and the time indicia 62 is the word "NOON". The time indicia 63 and 64 are the respective words "AFTERNOON" and "NIGHT". Thus, for example, the indicia 31 and 61 together state "MONDAY MORNING".

Each one of the closures includes a depending annular flange, such as the flange 72 (FIG. 3), which snaps into engagement with the mouth of the receptacle to secure releasably the closures in place and be readily openable.

In use, the user opens all of the closures so that all of the containers can be loaded with the prescribed medication for a week. Thereafter, the closures are snapped closed.

Assuming that the package 10 is thus loaded on a Sunday evening, the medication items (not shown) contained in the container 41 is removed first on the next Monday morning as indicated by the MONDAY day indicia 31 and the MORNING time indicia 61. The closure swings by its web to its open position in a plane substantially transverse to the face of the package 10 in a similar manner as indicated for the container 14 as shown in FIG. 2.

The closure hangs in its open position with its face and thus its time indicia 51, being obscured from view. In this regard, the closure hangs from the support member and faces it. As a result, the open closures do not have their time indicia shown to the user so that the user can very clearly determine which containers have been emptied and thus which one of the containers is the next one to be emptied.

In the present example, the next container is the container 41. The process continues until all containers have been emptied, and then they can be refilled.

It will become apparent to those skilled in the art that the cycle can be started at any intermediate container representing a desired time and day.

While a particular embodiment of the present invention has been disclosed, it is to be understood that various different modifications are possible and are contemplated within the true spirit and scope of the appended claims. For example, while the term "pharmaceutical items" has been used, it will become apparent to those skilled in the art that such terms might well include any type or kind of medication, such as a liquid medication, injectable medication, or the like. There is no intention, therefore, of limitations to the exact abstract or disclosure herein presented.

I claim:

1. A package adapted to store pharmaceutical items, comprising:

support means having a face thereon;

a plurality of containers mounted on said support means and arranged in groups;

day indicia means on said face arranged opposite each one of the groups of containers for determining which ones of said containers to be emptied during each day;

each one of said containers including receptacle means having open mouths for receiving and storing the pharmaceutical items, closure means having an outer face for covering the open mouths to retain removably the items therewithin, and hinge means for connecting said closure means and said support means for enabling said closure means to swing between a closed position over the respective mouths of said receptacle means to retain the pharmaceutical items therein, and an open position with said closure means disposed substantially in a plane transverse to said face to permit access thereof and to obscure from view the face of the open closure means;

time indicia means disposed on the outer faces of said closure means of each one of said container means of each group for indicating when said container means are to be emptied by the user thereof during certain times of the day and for indicating when selected ones of said container means are empty by having its closure means disposed in its open position with its time indicia being obscured from view, thereafter determining clearly that the items have been administered therefrom;

each one of said receptacle means includes a concave inner well to facilitate removal of the pharmaceutical items therefrom; and each one of said time indicia being in the form of a symbol.

2. A package according to claim 1, further including a second set of time indicia individually associated with each one of said container means.

3. A package according to claim 2, wherein said time indicia means includes a morning time symbol in the form of a representation of the rising sun.

4. A package according to claim 2, wherein said time indicia means includes a noon time symbol in the form of a representative of a noon time sun.

5. A package according to claim 2, wherein said time indicia means includes an afternoon time symbol in the form of a representation of the setting sun.

6. A package according to claim 2, wherein said time indicia means includes a night time symbol in the form of a representation of the moon.

7. A package according to claim 2, wherein said hinge means is in the form of a web to enable its closure means to hang suspended from said support means.

8. A package according to claim 7, wherein each one of said closure means includes a depending annular flange for snapping into engagement with the mouth of its receptacle means.

9. A package according to claim 8, wherein said day indicia includes the names of the days of the week.

* * * * *